US006077324A

United States Patent [19]

Fritz

[11] Patent Number: 6,077,324

[45] Date of Patent: Jun. 20, 2000

[54] METHOD FOR PRODUCING ALLOYED STEELS

[75] Inventor: Ernst Fritz, Linz, Austria

[73] Assignee: KCT Technologie GmbH, Dusseldorf, Germany

[21] Appl. No.: 08/584,819

[22] Filed: Jan. 11, 1996

[30] Foreign Application Priority Data

Jan. 16, 1995 [AT] Austria ..... 55/95

[51] Int. Cl.[7] ..... C21B 13/12

[52] U.S. Cl. ..... 75/10.12; 75/10.41; 75/10.42; 75/10.64; 75/961; 75/962; 420/129

[58] Field of Search ..... 75/10.61, 10.63, 75/10.64, 10.41, 10.42, 10.12, 961, 962; 420/129

[56] References Cited

U.S. PATENT DOCUMENTS

| | | | |
|---|---|---|---|
| 3,912,501 | 10/1975 | De Castejon | 75/10.34 |
| 3,947,267 | 3/1976 | d'Entremont et al. . | |
| 4,027,095 | 5/1977 | Kishida et al. . | |
| 4,177,061 | 12/1979 | Stenkvist et al. . | |
| 4,200,452 | 4/1980 | Savov et al. | 75/10.64 |
| 4,214,898 | 7/1980 | Iwanami et al. | 75/10.41 |
| 4,772,317 | 9/1988 | Rommerswinkel . | |
| 5,015,287 | 5/1991 | Yamada et al. | 75/10.17 |
| 5,112,387 | 5/1992 | Lazcano-Navarro | 75/10.42 |

FOREIGN PATENT DOCUMENTS

| | | | |
|---|---|---|---|
| 0 134 857 | 3/1985 | European Pat. Off. . | |
| 0 229 586 | 7/1987 | European Pat. Off. . | |
| 2 393 851 | 1/1979 | France . | |
| 25 07 631 | 9/1975 | Germany . | |
| 3056612 | 3/1991 | Japan | 75/10.41 |
| 57377 | 3/1969 | Luxembourg . | |
| 855006 | 8/1981 | U.S.S.R. | 75/10.63 |

OTHER PUBLICATIONS

Karl–Heinz Heinen eet al "Betriebsergebnisse und qualitative Vorteile einer sekundärmetallurgischen Behandlungslinie zur Erzeugung von Edelstählen", *Stahl und Eisen*, vol. 110, No. 8, Aug. 14, 1990, pp. 107–112.

Akademischer Verein, *Hütte*, Taschenbuch für Eisenhüttenleute, 1961, Verlag von Wilhelm Ernst & Sohn, Verlin, p. 661.

*Primary Examiner*—Melvyn Andrews
*Attorney, Agent, or Firm*—Hill & Simpson

[57] ABSTRACT

In a method for producing alloyed steels, wherein in a first manufacturing step iron carriers are to a great extent decarburized and dephosphorized by means of oxygen and after removal of the slag resulting therefrom the melt is adjusted to the desired alloy and carbon content in a further manufacturing step after addition of alloy carriers by means of oxygen and inert gas.

Especially in order to produce stainless steels in an economical manner while achieving a high level of productivity, in particular while charging major amounts of solids, the first manufacturing step is carried out under supply of electric energy in an electric furnace and the further manufacturing step is also effected under supply of electric energy, in an electric furnace that is to a great extent free from phosphorus-containing slag.

23 Claims, 1 Drawing Sheet

METHOD FOR PRODUCING ALLOYED STEELS

BACKGROUND OF THE INVENTION

The invention relates to a method for producing alloyed steels, particularly stainless steels or steel prematerial for stainless steels, wherein in a first manufacturing step iron carriers are to a great extent decarburized and dephosphorized by means of oxygen and after removal of the slag resulting therefrom the melt is adjusted to the desired alloy and carbon content in a further manufacturing step after addition of alloy carriers by means of oxygen and inert gas, and a plant for carrying out the method.

A method of this type is known from EP-A2-0 229 586. Here, both manufacturing steps are carried out in one and the same oxygen-blowing converter. With this method, the amount of solid matter that can be charged for melting is very limited. With the oxygen-blowing converter, the maximum amounts of solid pig iron, alloying elements and scrap that can be charged are 20 wt. % of a charge. When intending to charge larger amounts of solids, one is forced to add expensive exothermic chemical heating agents, which involves the disadvantage of considerable amounts of slag ($SiO_2$, $Al_2O_3$, etc.). These considerable quantities of slag call for substantial additions of lime and, as a result, major yield losses in terms of iron, chromium, manganese, etc. incur.

According to EP-A2-0 229 586 the oxygen-blowing converter is provided with a bottom flushing means, in order to produce a turbulence of the molten bath. In the oxygen-blowing converter, this leads to high levels of chromium being oxidized into the slag, so that the economy of the known method is destroyed. The economically viable lower limit (at still acceptable loss of chromium into the slag) in respect of carbon content is at 0.2% C.

Moreover, the lowest carbon contents (e.g. less than 0.1% carbon) cannot be adjusted.

Up to now difficulties have been encountered when producing higher-alloyed steels in an electric furnace, particularly chromium-alloyed stainless steels, since extremely high levels of chromium slagging occur as decarburization is effected in the electric furnace. To avoid loss of chromium into the slag, it has been suggested to adjust temperatures of far over 1700° C. during decarburization of the melt. As a consequence of these efforts, approximately 80% of stainless steels worldwide are made by converter methods.

The possibilities of the process route in the electric furnace—if desired in combination with a subsequent vacuum treatment—are very limited, in view of the charging materials that can be employed in an economical manner. Charging of phosphorus for example had to be limited to less than 0.030% and charging of carbon to less than f.i. 1%, since in the presence of chromium and due to reduction of the chrome oxide, dephosphorization is almost impossible and extensive decarburization in the electric furnace has not been successful so far because of the long periods involved and the high level of chromium slagging. In spite of the low carbon levels introduced when fusing low-P stainless alloyed scrap instead of major amounts of high-carbon ferro-chromium, premelts in electric furnaces conventionally have to be tapped at C contents of 0.5% to 1.2% and therefore must be subjected to a prolonged vacuum treatment in order to adjust the required low C contents, etc. The cost of this prolonged vacuum treatment is high and sequence casting is not possible.

SUMMARY OF THE INVENTION

The invention aims at avoiding these disadvantages and difficulties and has as its object to provide a method of the type initially defined as well as a plant for carrying out the method, making it feasible to manufacture alloyed steels, particularly stainless steels, in an economical manner while achieving a high level of productivity. In particular it is to be feasible to employ low-cost high-energy, yet phosphorus-containing molten and/or solid pig iron with more than 0.03% phosphorus. Further it is to be feasible according to the invention to charge major amounts of solids, particularly up to as much as 100%.

According to the invention this object is achieved in that the first manufacturing step is carried out under supply of electric energy in an electric furnace and the further manufacturing step is also carried out under supply of electric energy in an electric furnace which is to a great extent free from phosphorus-containing slag.

The method according to the invention renders it feasible to adjust medium and lowest carbon contents without any subsequent vacuum treatment. If a vacuum treatment is to be carried out even at lowest carbon contents, the treatment may be limited to a very short period.

Preferably, in order to achieve high reaction velocities in desiliconizing, decarburizing, decomposition of high-carbon ferro-chromium, etc., a bath turbulence is initiated during the further manufacturing step, by feeding gas into the melt, preferably in a minimum amount of 30 l/min per feed-in site if feeding inert gas and 300 l/min if feeding oxygen or oxygen-containing mixed gases.

According to a preferred embodiment, at least during one partial step of the further manufacturing step decarburization is carried out by submerged blowing with oxygen or an oxygen-containing mixed gas, whereby chromium slagging can be kept particularly low even at high decarburization velocities.

It is also possible during the further manufacturing step to carry out decarburization by top blowing oxygen or an oxygen-containing mixed gas onto the melt.

Suitably, during submerged blowing an inert gas is admixed to the oxygen or the oxygen-containing mixed gas respectively, at a percentage which increases as the submerged blowing progresses.

A preferred embodiment is characterized in that the first manufacturing step is carried out in a first electric furnace and the further manufacturing step in a further electric furnace which is different from the first electric furnace. Feeding the charge to a second electric furnace for carrying out the further manufacturing step makes it easy to keep the melt free from phosphorus-containing slag, which in spite of the deslagging in the first electric furnace still clings to the lining. Since this leads to the melt being almost completely dephosphorized, the further manufacturing step, i.e. alloy adjustment and further decarburization, can be carried out in the absence of phosphorus.

To adjust the chemical composition and for deoxidization as well as desulfurization and for applying a flushing treatment, it may be suitable to follow the further manufacturing step with an additional manufacturing step involving a vacuum treatment of the melt.

Advantageously, during at least one partial step of the further manufacturing step flushing of the melt with inert gas or a mixture of inert gas and hydrocarbon is effected. This can be done for instance by means of tuyères which are positioned in the wall of the electric furnace close above the normal level of the melt and, whenever the vessel is being tilted, will lie below the surface of the melt. Thus, these tuyères lie above the melt (and slag) while not being used, and this will extend their useful life.

Preferably, the metal yield will be increased and the consumption of reducing agents reduced, if the further manufacturing step is effected under almost complete exclusion of air. Entry of secondary air, particularly during reduction of the slag and/or deoxidizing of the melt, is avoided in an economical manner by sealing the slag door and the partition of the furnace wall and the furnace lid f.i. by means of ceramic fibers.

The method according to the invention is of particular advantage if more than 20 wt. %, preferably more than 40 wt. % of the iron carriers in the charge consist of scrap.

Suitably the further manufacturing step is carried out while retaining part of the slag obtained from the further manufacturing step preceding the further manufacturing step.

The $Cr_2O_3$-containing slag, which in the second electric furnace originates from the previous heat and which is formed by partial oxidation of the silicon from the ferrochromium and the added lime, etc., is reduced predominantly by silicon and carbon from the ferrochromium and can already be deslagged at high chromium yield levels and minimum consumption of reducing agents, such as FeSi, prior to fine decarburization in the electric furnace.

Preferably, the slag is reduced in the further manufacturing step during flushing with inert gas under addition of reducing agents, lime and fluxing agents and the melt is deoxidized and desulfurized, so that in the further manufacturing step the final carbon content required for the desired steel quality, the rest of the chemical analysis and the desired temperature of the melt may be achieved.

Other preferred embodiments can be seen from the further sub-claims.

It is also in accordance with the object of the invention that during the first manufacturing step solid matter—f.i. electric-furnace or converter dust, coal for foaming the slag, slag formers, ores, fine-grained alloying agents, materials which have to be disposed, such as sewage sludge, grained light shredder fraction, grinding dust, iron scale, etc.—and during the further manufacturing step preferably fine-grained ore, f.i. chrome ore as Cr—and oxygen carriers (for Si oxidation) with or without admixing some reducing agent (e.g. FeSi, coal) and/or coal or nickel oxide be blown against the electric arcs and onto the top of the melt through hollow electrodes of the electric furnace.

A plant for carrying out the method is characterized in that it includes at least one electric furnace with blowing-in lances disposed above the normal molten bath level and penetrating the furnace side wall, and with submerged nozzles provided in the lower part of the hearth.

Here, the submerged nozzles suitably are constructed as jacketed nozzles, wherein it is feasible to feed in hydrocarbon and/or mixtures of hydrocarbon and inert gas and/or $CO_2$ and/or water vapor through the jacket.

According to a preferred embodiment the blowing-in lances provided above the normal molten bath level are constructed as refining lances which are mounted to the furnace side wall in a manner allowing for them to be swiveled and to be moved lengthwise.

It is particularly advantageous if a further electric furnace is provided for carrying out the further manufacturing step.

In the following, the invention will be described in a more detailed manner by means of an exemplary embodiment illustrated in the drawings. section of an electric furnace in schematic representation.

DESCRIPTION OF THE PREFERRED EMBODIMENTS

Figure 1:
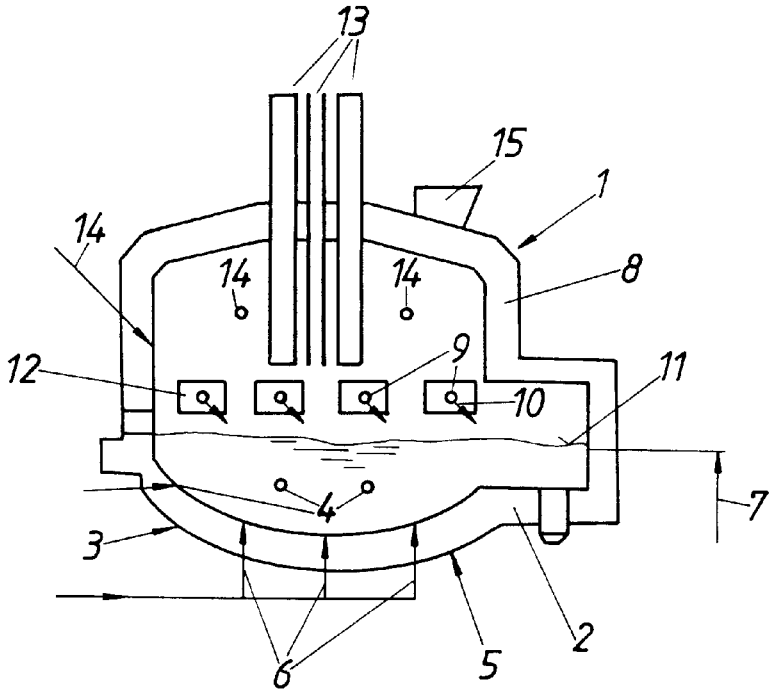
FIG. 1 is a schematic cross sectional view of a first electric furnace used in the process according to the present invention.

An electric furnace 1 provided for the first manufacturing step according to FIG. 1 is fitted with three submerged nozzles 4 in the refractory lining 2 of the lower part of the hearth 3. The submerged nozzles 4 are nozzles which are formed by two or three concentric pipes—in the manner of jacketed nozzles—, wherein the process gas streams inside the innermost round central pipe and shielding gas for the nozzles streams in the annular or segment-shaped blowing cross sections between the pipes. Preferably hydrocarbon, such as propane, butane or a mixture of hydrocarbon and inert gas is employed as a shielding gas. By way of an experiment, water vapor, $CO_2$, light fuel oil, CO, inert gas or mixtures thereof have also been successfully applied as protective media. Annular-gap nozzles with their central pipe stuffed with refractory material and in which process gas was fed in through a discontinuous annular gap have likewise been successfully employed as submerged nozzles 4.

In the bottom region 5 of the lower part of the furnace 3, three flushing elements 6 are positioned, consisting of two pipes each. Each inner pipe is closed by refractory material. The annular gaps may also take the form of segments. The flushing elements 6 may also be made from a refractory material that is porous, ferroclad or provided with thin pipes.

Above the normal molten bath level 7 or the slag, stationary refining lances 9 are arranged in the furnace side wall 8. These refining lances 9 consist of two or three concentric pipes or of one water-cooled pipe. The direction of the arrow 10 indicates that the refining lances blow obliquely downwards, as a tangent to an imaginary cylinder and at a relatively short distance from the bath surface 11. The refining lances 9 are disposed in water-cooled cooling boxes 12 of copper. Furthermore, one of the three electrodes 13 is depicted as a hollow electrode. Three afterburning/burner lances 14 are disposed in the upper portion of the furnace side wall 8. An opening 15 serves for admitting slag formers and alloying agents.

Figure 2:
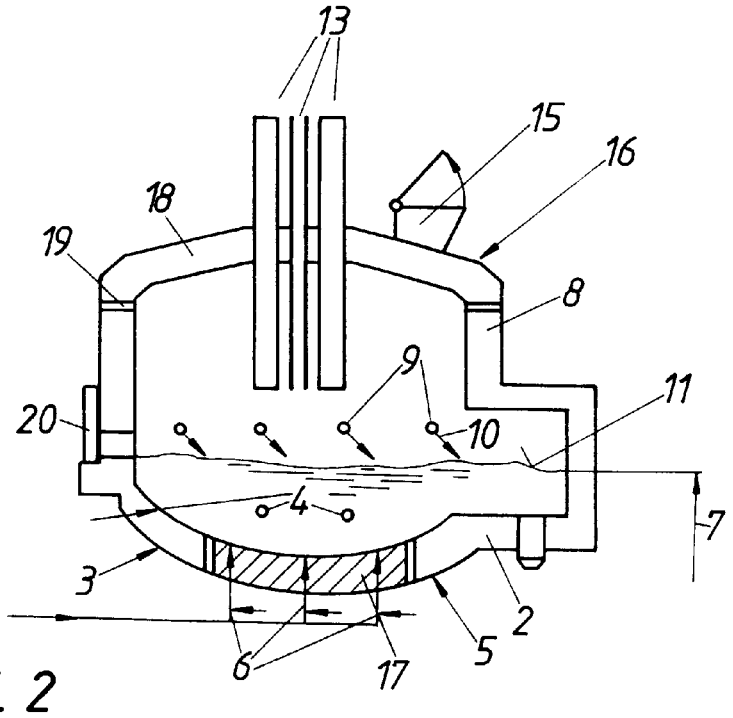
FIG. 2 is a schematic cross sectional view of a second electric furnace used in the process of the present invention.

FIG. 2 depicts a second electric furnace 16 according to the invention, in schematic representation. As a specific feature, this furnace—in contrast to the electric furnace 1 shown in FIG. 1—has a bottom part 17 which can be exchanged and which, inside, is provided with the three flushing elements 6.

An electrode 13 is constructed as a hollow electrode lined with a ceramic pipe. Alloying agents are charged to the furnace (second electric furnace) by means of a scrap charging box (not illustrated) via the opening 15 in the furnace lid 18. The seals 19 at the partition separating the furnace side wall 8 from the furnace lid 18 and the slag door 20 from the furnace side wall 8 as well as the seal at the opening 15 in the furnace lid 18 are made from ceramic fiber. At least temporarily, the furnace lid 18 is pressed against the furnace side wall 8 by means of a damping device.

The following is a more detailed discussion of the method according to the invention: A 100 t electric furnace 1 (first electric furnace) with 70 MW nominal power is charged solid and liquid materials per ton of molten steel (AISI 304) charged:

400 kg molten pig iron with 4.3% C, 0.10% Si and 0.1% P, 30 kg solid pig iron, 110 kg unalloyed scrap, 20 kg lime, 15 kg filter dust (blown in through a hollow electrode) and 180 kg FeNi.

Gas consumption per ton of molten steel is calculated as follows:

15 $Nm^3$ $O_2$/t are admitted into the refining lances 9, and 8 $Nm^3O_2$/t and 1.1 $Nm^3CH_4$/t into the submerged nozzles 4. 1.2 $Nm^3N_2$ plus 0.3 $Nm^3CH_4$/t are blown through the flushing elements 6 to improve bath turbulence and yield. Current consumption with the electric furnace 1 is 130 kWh/t of molten steel final product (from the second electric furnace). 50 kg slag are deslagged. 680 kg premelt with 0.2% C, 0.020% P and having a temperature of 1590° C. are passed on to the second electric furnace 16. The time between taps is 57 min.

Per t of molten steel (AISI 304) approx. 60 kg slag from the previous charge are recirculated and 680 kg of premelt, 350 kg HCFeCr, FeMn, FeSi and 45 kg lime as well as 10 kg dolomite are charged to the second electric furnace 16 (100 t electric furnace with 70 MVA). 30 kg chrome ore are blown in through the hollow electrode 13, to save FeCr and for silicon oxidation.

Per t molten steel (AISI 304), 20 $Nm^3O_2$ are blown onto the melt through the refining lances 9, 5 $Nm^3$ $O_2$ are blown into the melt through self-consuming pipes and 8 $Nm^3O_2$+2 $Nm^3Ar$+1 $Nm^3$ $CH_4$ through the submerged nozzles 4. The entry of secondary air into the second electric furnace 16 is substantially prevented (by clamping the furnace lid 18 against the furnace side wall 8). 125 kg slag are to a great extent reduced and deslagged by means of the silicon from the HCFeCr and the carbon. 100 t molten steel with 0.3% C, 18.1% Cr and 0.022% P and 8.5% Ni are tapped from the second electric furnace 16 after 55 min of treatment and are finally refined for 48 min, deoxidized, fine-alloyed, desulfurized and flushed in the vacuum-treatment plant employing 7 $Nm^3O_2$ and 0.3 $Nm^3$ Ar/t. These charges are poured in sequence castings.

With other charges—at similar levels of consumption—the melt is refined to 0.04% C in the second electric furnace 16 by means of submerged nozzles 4 by blowing $O_2$+Ar/$CH_4$+Ar, the slag is reduced while blowing inert gas and adding FeSi and lime, and after intermediate deslagging and renewed charging of lime the melt is desulfurized, knocked out, fine-alloyed, flushed and poured. The period of treatment in the second electric furnace 16 is approx. 70 min.

Dephosphorization of the iron carriers pig iron and scrap, circulating substances, FeNi, etc. is done in the first electric furnace 1.

The $P_2O_5$-containing slag is removed from the plant, i.e. from the electric furnace 1, before this to a great extent decarburized premelt is charged into the second electric furnace 16, alloyed, desiliconized and decarburized. A short very fine decarburization treatment, deoxidizing, desulfurization and re-flushing may be carried out in a vacuum plant (f.i. a VOD plant).

Decarburization to medium or very low carbon contents while keeping chromium slagging to a minimum is made possible by stationary submerged nozzles 4 and/or 6 which blow oxygen—or oxygen-containing mixed gases for lowering CO partial pressure—and partly by stationary and/or movable top-blowing nozzles 9 or top-blowing lances.

The process steps are structured in such a way that:

maximum flexibility regarding the use of substantial amounts of low-cost charging substances (P-containing pig iron, HCFeCr, etc.) is ensured, an electric furnace 1 is used for melting, superheating P-containing substances, such as pig iron, as well as desiliconizing, decarburizing and dephosphorizing the premelt and the second electric furnace 16 is used for rapidly melting HCFeCr, desiliconizing, reducing the slag, decarburizinig, etc., the high reaction velocities in desiliconizing, decarburizing, dephosphorizing, the disintegration of HCFeCr, etc. are achieved by applying intensive bottom flushing combined with stationary refining lances 9 (the lower level of Cr oxidation is achieved by submerged blowing of oxidizing gases), short operating periods per process step for sequence casting and minimum consumption of operational means is ensured. With one embodiment of the method, the $Cr_2O_3$-containing slag is f.i. not removed from the second electric furnace 16 after tapping of the melt and is reduced along with the Si or C respectively from the HCFeCr and subsequently is deslagged. Due to the short duration of fine decarburization in the vacuum plant, argon consumption—to cite just one example—is also reduced.

In accordance with the object of the invention, the above-described features are combined at will and adapted to the permanent or temporary operating conditions (f.i. lining of one of the two electric furnaces or repairs of the VOD plant, etc.) and the plants existing in different steelworks.

What I claim is:

1. A method for producing alloyed steels including stainless steels and steel prematerial for stainless steels, said method including performing a first set of manufacturing steps of decarburizing and dephosphorizing a first melt of an iron carrier, which contains carbon and phosphorus, in an electric arc furnace by supplying an electrical energy to the furnace and by both submerge blowing and top blowing of oxygen to the first melt, then removing the slag resulting therefrom to create a second melt and performing a second set of manufacturing steps of adjusting the alloy and carbon content of the second melt by supplying electric energy to the second melt and by applying oxygen and inert gas with alloy carriers in an electric arc furnace with the second melt being free of phosphorus-containing slag.

2. A method according to claim 1, wherein the second set of manufacturing steps includes creating a bath turbulence by feeding a gas into the second melt, said gas being selected from a group consisting of an inert gas in a minimum amount of 30 l/min per feed-in site and oxygen-containing gas in an amount of 300 l/min.

3. A method according to claim 1, wherein at least one step of the second set of manufacturing steps includes decarburizing by submerged blowing with a gas selected from oxygen and an oxygen-containing mixed gas.

4. A method according to claim 3, wherein, during submerged blowing, an inert gas is admixed with the gas at a percentage which increases as the submerged blowing proceeds.

5. A method according to claim 1, wherein the second set of manufacturing steps includes decarburizing by top blowing a gas onto the second melt, said gas being selected from an oxygen-containing mixed gas and oxygen.

6. A method according to claim 1, wherein the first set of manufacturing steps is carried out in a first electric are furnace and the second set of manufacturing steps is carried out in a second electric out furnace which is different from the first electric are furnace.

7. A method according to claim 1, which includes an additional set of manufacturing steps following the second set of manufacturing steps, said additional set including subjecting the second melt to a vacuum treatment.

8. A method according to claim 1, wherein the s eon d set of manufacturing steps includes flushing of the second melt with a gas selected from an inert gas and a mixture of inert gas and hydrocarbon.

9. A method according to claim 1, wherein the second set of manufacturing step s is carried out under almost complete exclusion of air.

10. A method according to claim 1, wherein the first melt of an iron carrier includes a charge of more than 20 wt % scrap.

11. A method according to claim 1, wherein the first melt of an iron carrier includes a charge of more than 40 wt % scrap.

12. A method according to claim 1, wherein the second set of manufacturing steps is carried out while retaining part of the slag obtained from a previous second set of manufacturing steps.

13. A method according to claim 1, which includes reducing the slag during the second set of manufacturing steps durings flushing with inert gas by an addition of reducing agents, lime and fluxing agents so that the second melt is deoxidized and desulfurized.

14. A method according to claim 13, wherein the furnace atmosphere is adjusted during slag reduction by feeding in a gas selected from a non-oxidizing gas and a slight oxidizing gas, while almost completely avoiding a take-in of secondary air.

15. A method according to claim 14, which includes checking the chemical analysis of the furnace atmosphere and continuously readjusting the atmosphere in view of the analysis.

16. A method according to claim 13, wherein the second set of manufacturing steps includes maintaining a negative gas pressure in the electric are furnace at least during the reduction periods.

17. A method according to claim 1, wherein the second set of manufacturing steps includes introducing solid matter directly into the electric arc through hollow electrodes of the electric are furnace.

18. A method according to claim 17, wherein the solid matter is selected from a group consisting of fine chrome ore and partially pre-reduced chrome ore and said solid matter is fed in to serve as a chromium- and oxygen-carrier.

19. A method according to claim 1, wherein both the first set and second set of manufacturing steps includes feeding inert gas into the respective melt to initiate both turbulence and top blowing oxygen or oxygen-containing mixed gas to oxidize silicon and carbon.

20. A method according to claim 1, wherein the second set of manufacturing steps is carried out in the electric are furnace in which the first set of manufacturing steps has been effected, with the second melt being tapped after the first set of manufacturing steps and the phosphorus-containing slag completely removed from the electric are furnace and the second melt being subsequently charged back into the electric furnace.

21. A method according to claim 1, wherein one of the first set of manufacturing steps and the second set of manufacturing steps includes introducing into the superheated melt matter selected from a group consisting of filter dust from steelmaking plants, ore, pre-reduced ore, iron carbide, alloying additions, residual substances, dust, scales, chips, slags, granular plastic material, liquids, hazardous substances intended for disposal and mixtures thereof.

22. A method according to claim 1, wherein the $aCr_2O_3$ containing slag obtained from the prior second manufacturing step is tapped and subsequently reduced in a reaction vessel for chromium recovery by the addition of a material selected from silicon carriers and other reducing agents, and the chromium thus recovered is used for alloying the second melt during the second set of manufacturing steps.

23. A method according to claim 1, which includes direct blowing a material selected from coal and coke along with oxidizing gases to reduce current consumption and to stabilize foaming of the slag.

* * * * *